US006776132B2

(12) United States Patent
Kudo et al.

(10) Patent No.: US 6,776,132 B2
(45) Date of Patent: Aug. 17, 2004

(54) INTAKE ARRANGEMENT FOR MULTI-CYLINDER ENGINE

(75) Inventors: Yuji Kudo, Kanagawa (JP); Masahiro Murata, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/268,745

(22) Filed: Oct. 11, 2002

(65) Prior Publication Data

US 2003/0075135 A1 Apr. 24, 2003

(30) Foreign Application Priority Data

Oct. 19, 2001 (JP) ..... 2001-321927

(51) Int. Cl.[7] ..... F02M 35/10
(52) U.S. Cl. ..... 123/184.42
(58) Field of Search ..... 123/184.21, 184.24, 123/184.34, 184.38, 184.47, 184.55, 470, 456, 184.61

(56) References Cited

U.S. PATENT DOCUMENTS 4,909,221 A * 3/1990 Heuser ..... 123/470
5,353,752 A * 10/1994 Suzuki ..... 123/184.61
5,630,387 A * 5/1997 Kamiyama ..... 123/184.38
5,771,863 A * 6/1998 Daly ..... 123/456
5,927,254 A * 7/1999 Ino et al. ..... 123/470

FOREIGN PATENT DOCUMENTS

JP 11-324842 11/1999

* cited by examiner

*Primary Examiner*—Tony M. Argenbright
*Assistant Examiner*—Hyder Ali
(74) *Attorney, Agent, or Firm*—Foley & Lardner LLP

(57) ABSTRACT

An intake arrangement for a multi-cylinder internal combustion engine of a vehicle which has a row of cylinders. The arrangement includes an intake manifold, which includes a collector extending along a direction of the row of the cylinders and a branch portion communicated with the collector, a fuel pipe extending along the collector, and a protector extending along the fuel pipe between the branch portion and the fuel pipe. The fuel pipe is disposed at a downstream end portion of the branch portion which allows air to be introduced into the cylinders. The protector is secured to the downstream end portion of the branch portion and deformable to cover the fuel pipe upon an impact load being applied to the branch portion.

23 Claims, 8 Drawing Sheets

INTAKE ARRANGEMENT FOR MULTI-CYLINDER ENGINE

BACKGROUND OF THE INVENTION

The present invention relates to an intake arrangement for a multi-cylinder internal combustion engine of a vehicle, and more specifically to an intake arrangement made of resin material.

There have been conventionally proposed intake manifolds which are made of not metal material such as aluminum but resin material in order to reduce the cost and the weight.

SUMMARY OF THE INVENTION

The intake manifolds made of resin material, however, have less rigidity as compared with intake manifolds made of metal material. Therefore, if an impact load is applied to the engine room upon vehicle collision and the intake manifold made of resin material may become deformed, the deformed intake manifold will be urged toward a fuel pipe adjacent thereto so that the fuel pipe is deformed. Further, the intake manifold made of resin material will be readily vibrated because of the less rigidity. If the vibration produced in the intake manifold is transmitted to a fuel injector, fuel sprayed from the fuel injector will be prevented from being directed toward a target area of the fuel injection. This will cause deterioration in combustion properties.

It would threrefore be desirable to provide an intake arrangement for an internal combustion engine of a vehicle in which a protector for a fuel pipe is used. The protector is deformed so as to protect a fuel pipe upon applying an impact load to the intake arrangement, such as at the occurrence of vehicle collision. Owing to the deformation of the protector, the impact load applied to the intake arrangement can be reduced, and the fuel pipe can be prevented from being deformed. Further, it would be desirable to provide an intake arrangement for an internal combustion engine of a vehicle which can be enhanced in rigidity by using a protector for a fuel pipe. The intake arrangement having the enhanced rigidity can reduce vibration caused therein, serving for preventing the fuel pipe and a fuel injector from suffering from the vibration transmitted from the intake arrangement.

In one aspect of the present invention, there is provided an intake arrangement for a multi-cylinder internal combustion engine of a vehicle, the engine having a row of cylinders, the arrangement comprising:

an intake manifold including a collector adapted to extend along a direction of the row of the cylinders and a branch portion communicated with the collector, the intake manifold being adapted to introduce air to the cylinders via the collector and the branch portion, the branch portion having a downstream end portion allowing the air to be introduced into the cylinders;

a fuel pipe disposed at the downstream end portion of the branch portion, the fuel pipe extending along the collector; and a protector secured to the downstream end portion of the branch portion, the protector extending along the fuel pipe between the branch portion and the fuel pipe, the protector being deformable to cover the fuel pipe upon an impact load being applied to the branch portion.

In a further aspect of the present invention, there is provided an intake arrangement for a multi-cylinder internal combustion engine of a vehicle, the engine having a row of cylinders, the intake arrangement comprising:

an intake manifold including branch means for allowing a flow of air to be divided into branch flows introduced into the cylinders;

pipe means for supplying fuel to the cylinders on a downstream side of the branch means; and protector means for preventing the pipe means from being deformed upon an impact load being applied to the branch means, the protector means being deformable to cover the pipe means upon the application of the impact load.

DETAILED DESCRIPTION OF THE PREFERRED EMBODIMENT

Figure 6:
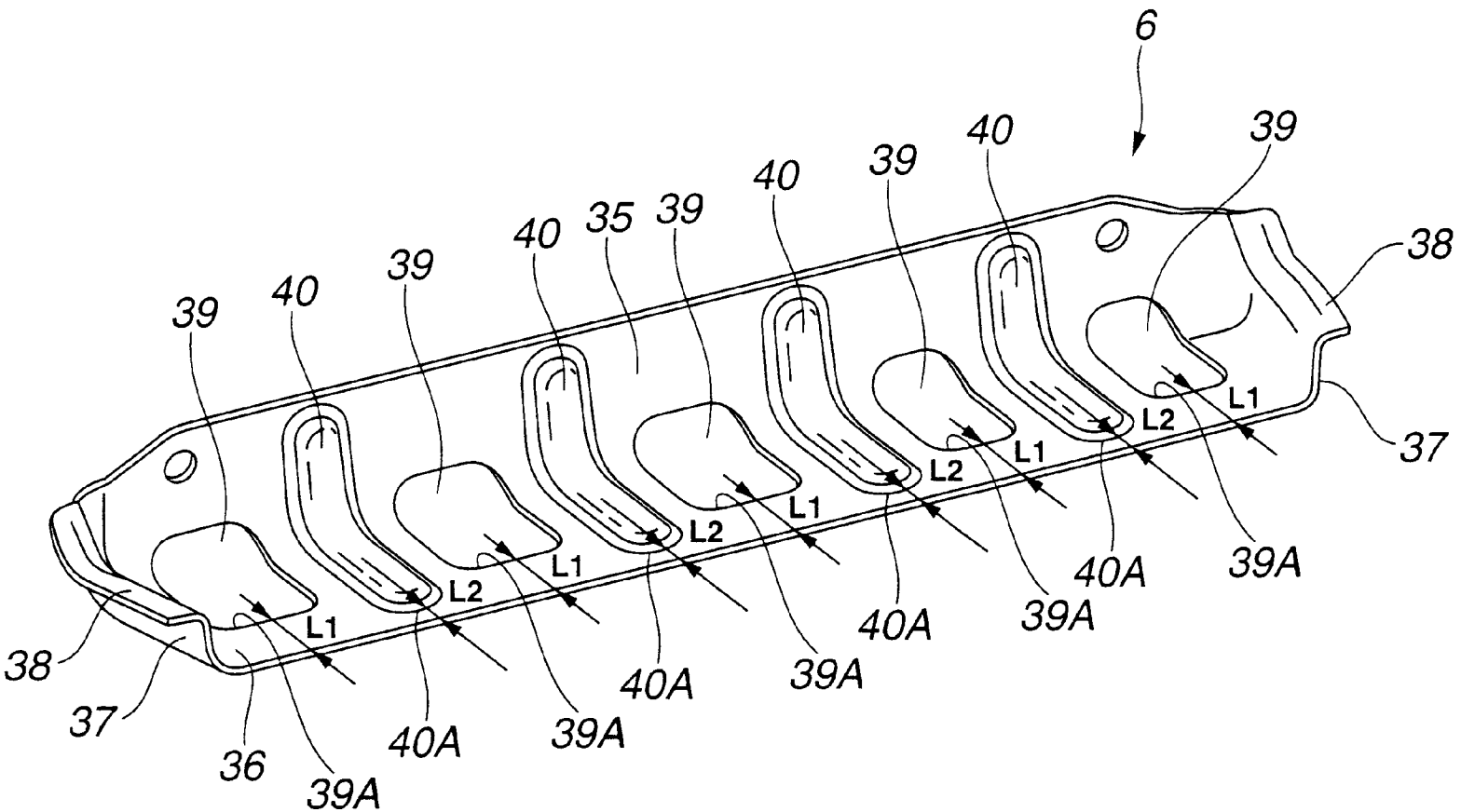
FIG. 6 is a perspective view of the protector of FIG. 5.
Figure 7:
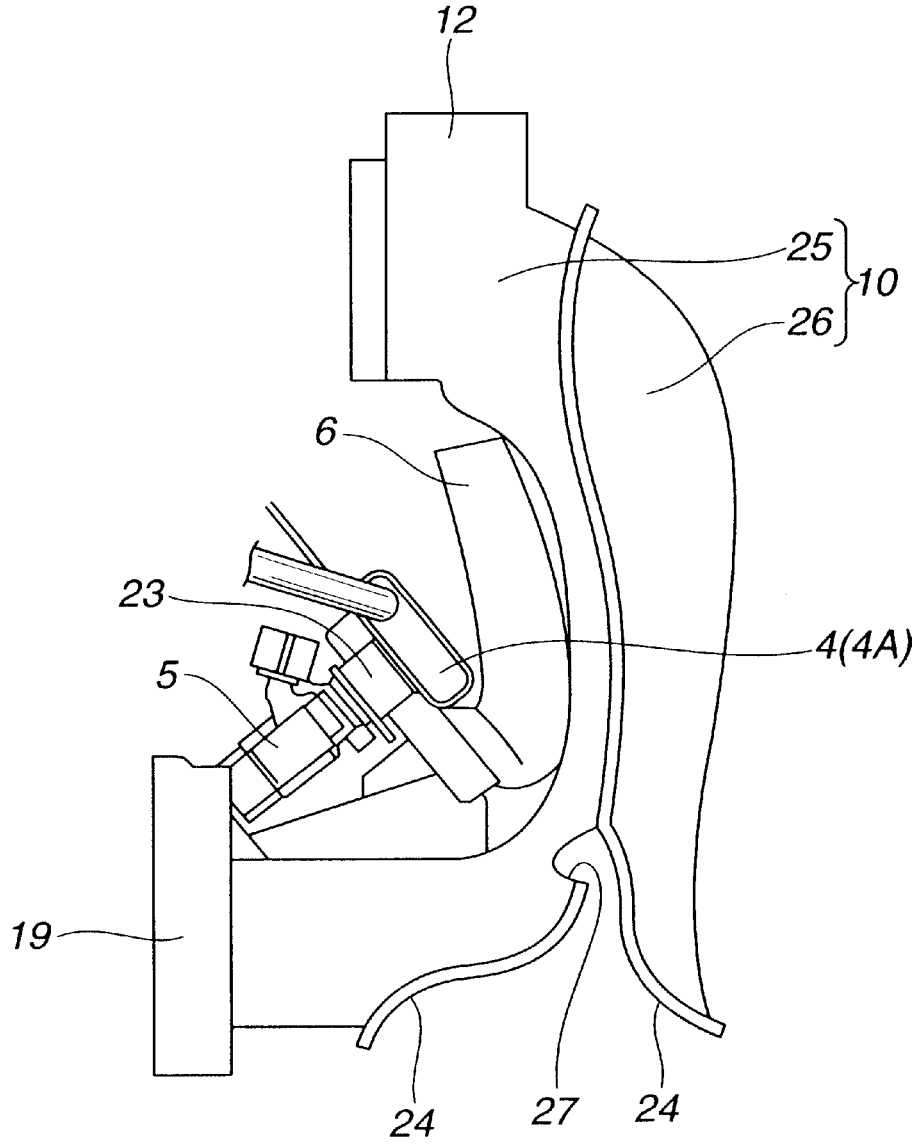
FIG. 7 is an explanatory diagram of deformation of the lower branch and the protector upon an impact load being applied to the intake manifold.
Figure 8:
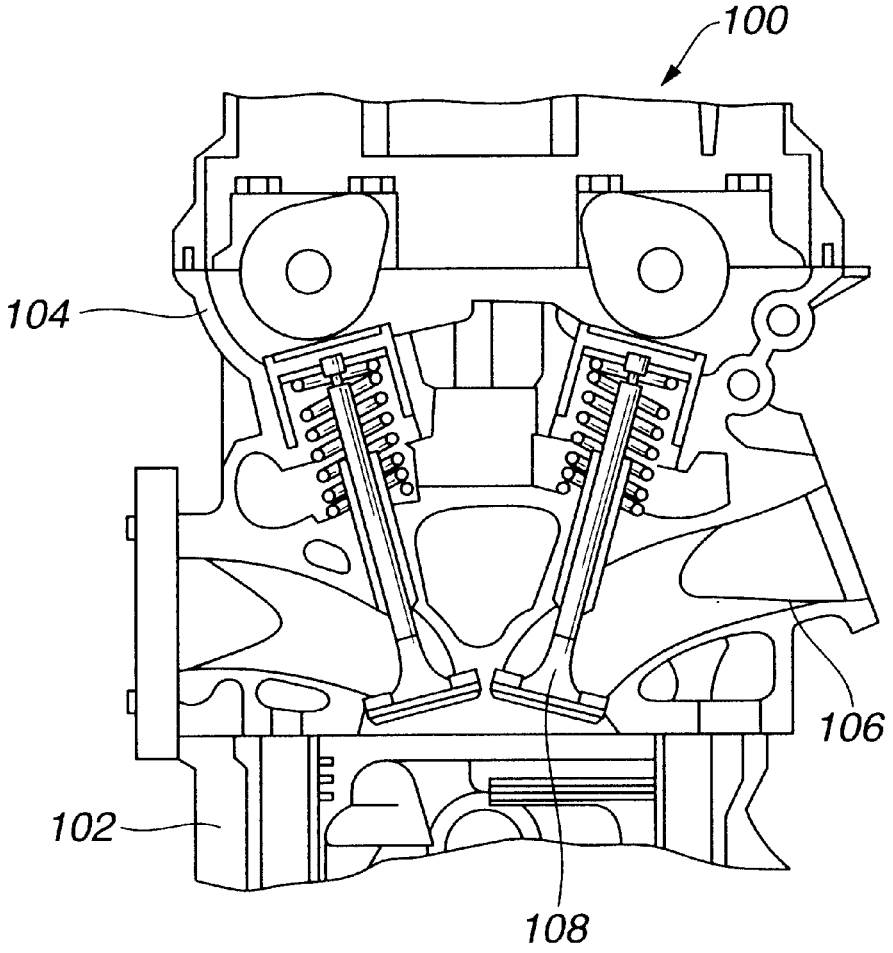
FIG. 8 is a vertical sectional view of the engine.

Referring now to FIGS. 1–7, there is shown an arrangement for a multi-cylinder internal combustion engine of a vehicle, according to a preferred embodiment of the present invention. In this embodiment, the arrangement is applied to a four-cylinder engine. FIG. 8 shows engine 100 including cylinder block 102 and cylinder head 104. Four cylinders are defined in cylinder block 102 so as to be arranged in a row. Cylinder head 104 is disposed on the top of cylinder block 102. Cylinder head 104 has intake ports 106 corresponding to the cylinders. Intake valve 108 is disposed in each of intake ports 106 and operated to open and close intake ports 106.

Figure 1:
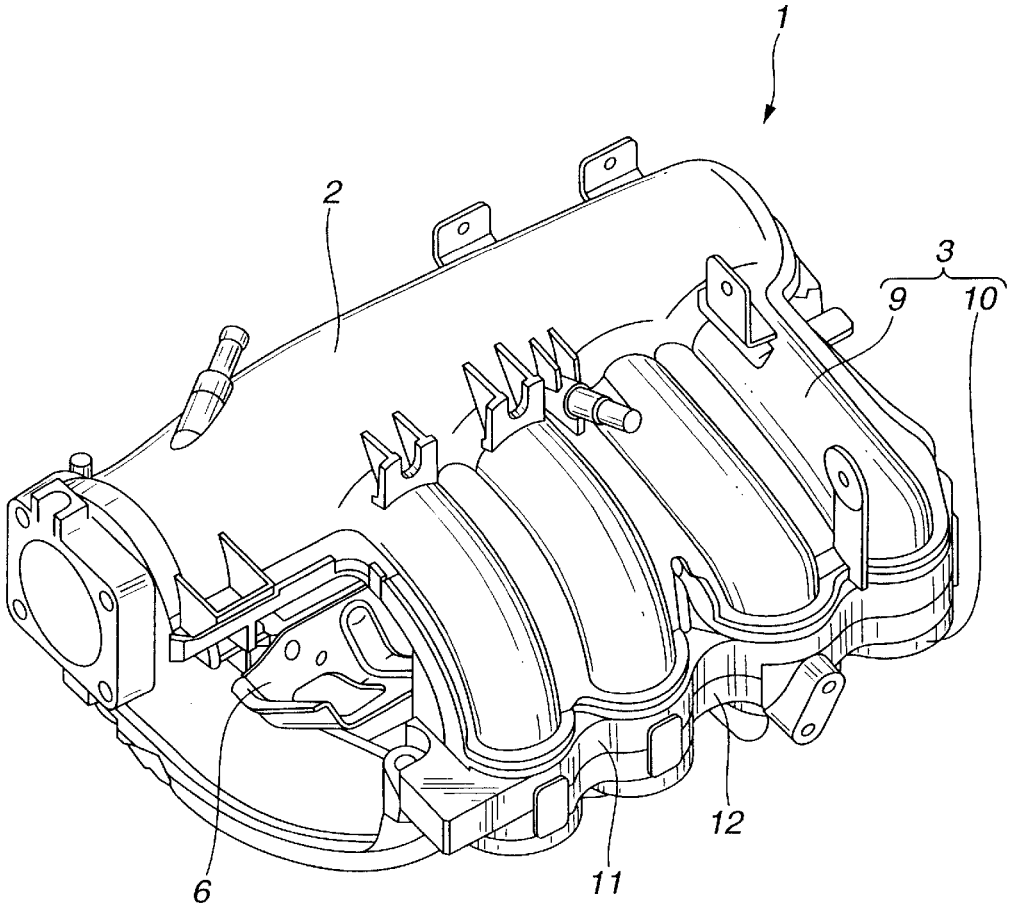
FIG. 1 is a perspective view of an intake arrangement for an internal combustion engine, according to an embodiment of the present invention.
Figure 2:
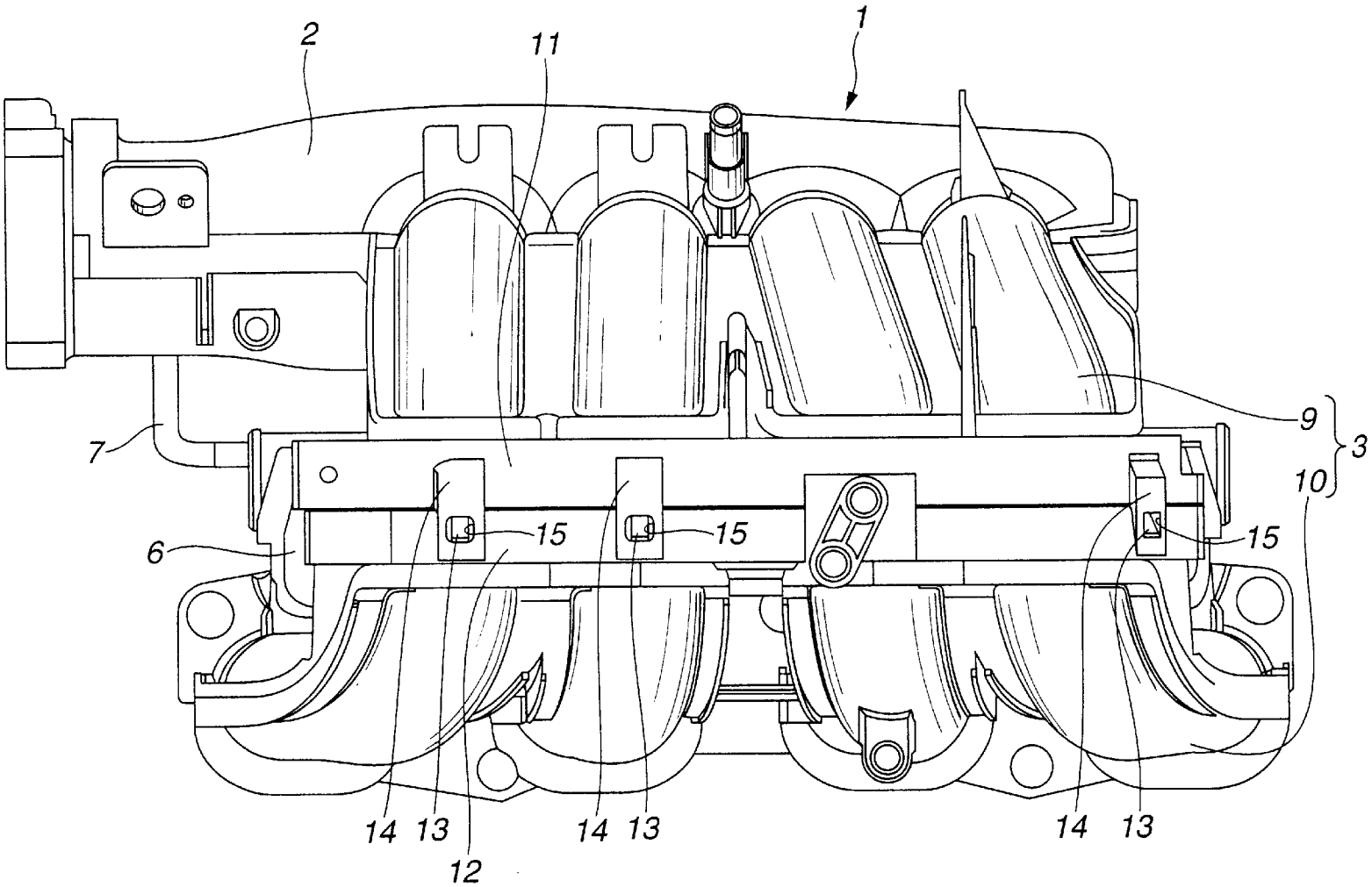
FIG. 2 is an front view of the intake arrangement shown in FIG. 1.
Figure 3:
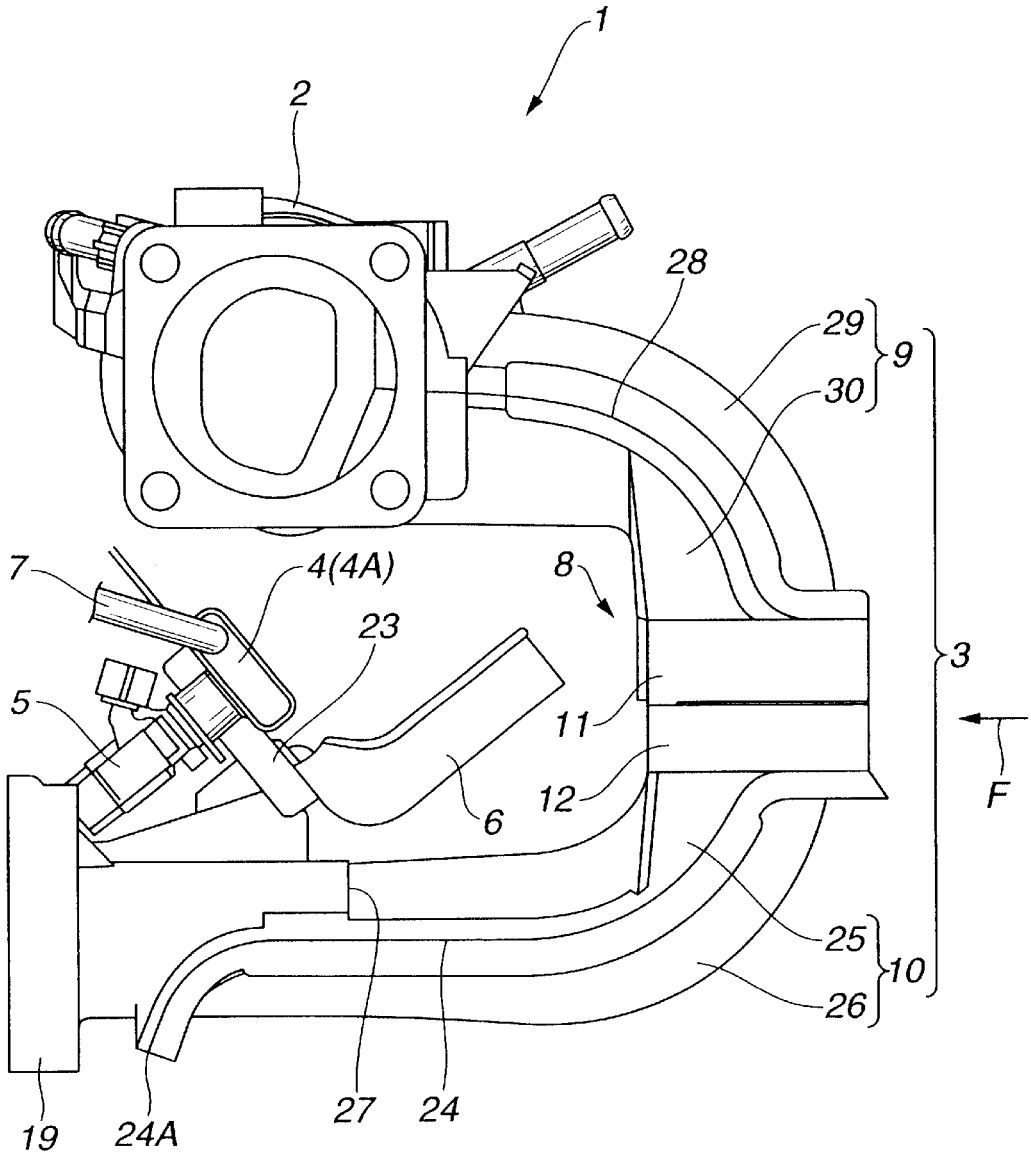
FIG. 3 is a side view of the intake arrangement shown in FIG. 1

The arrangement includes intake manifold 1, fuel pipe 4 and protector 6 for fuel pipe 4, as better shown in FIG. 3. Intake manifold 1 is made of resin material and allows air to be introduced to the engine cylinders. As illustrated in FIGS. 1–3, intake manifold 1 includes collector 2 and branch portion 3 communicated with collector 2. Collector 2 is disposed above cylinder head 104 of engine 100 shown in FIG. 8 and allows a main flow of the air. Collector 2 has a generally elongated cylindrical shape extending along the row of cylinders. Branch portion 3 connects collector 2 to intake port 106 of each cylinder of engine 100 and allows the main flow of air in collector 2 to be divided into branch flows each introduced into the cylinder via intake port 106. In this embodiment, branch portion 3 has four branches corresponding to the four cylinders extending in a transverse direction relative to the longitudinal axis of collector 2.

As illustrated in FIG. 3, branch portion 3 has a generally U-shape. Branch portion 3 includes upper branch 9 and lower branch 10 which are joined with each other at bent portion 8 of the U-shape. Upper branch 9 has downstream end portion 11 relative to the air flow flowing through branch portion 3 into intake port 106, and lower branch 10 has upstream end portion 12 relative to the air flow. Downstream end portion 11 and upstream end portion 12 are joined with each other with the combined use of bolts and so-called snap-fit assemblies. Namely, as shown in FIG. 2, each of the snap-fit assemblies is constituted of projection 13 and hole 15 which are engaged with each other. Projection 13 is formed at upstream end portion 12. Hole 15 is formed in tab 14 projecting from downstream end portion 11.

Figure 4:
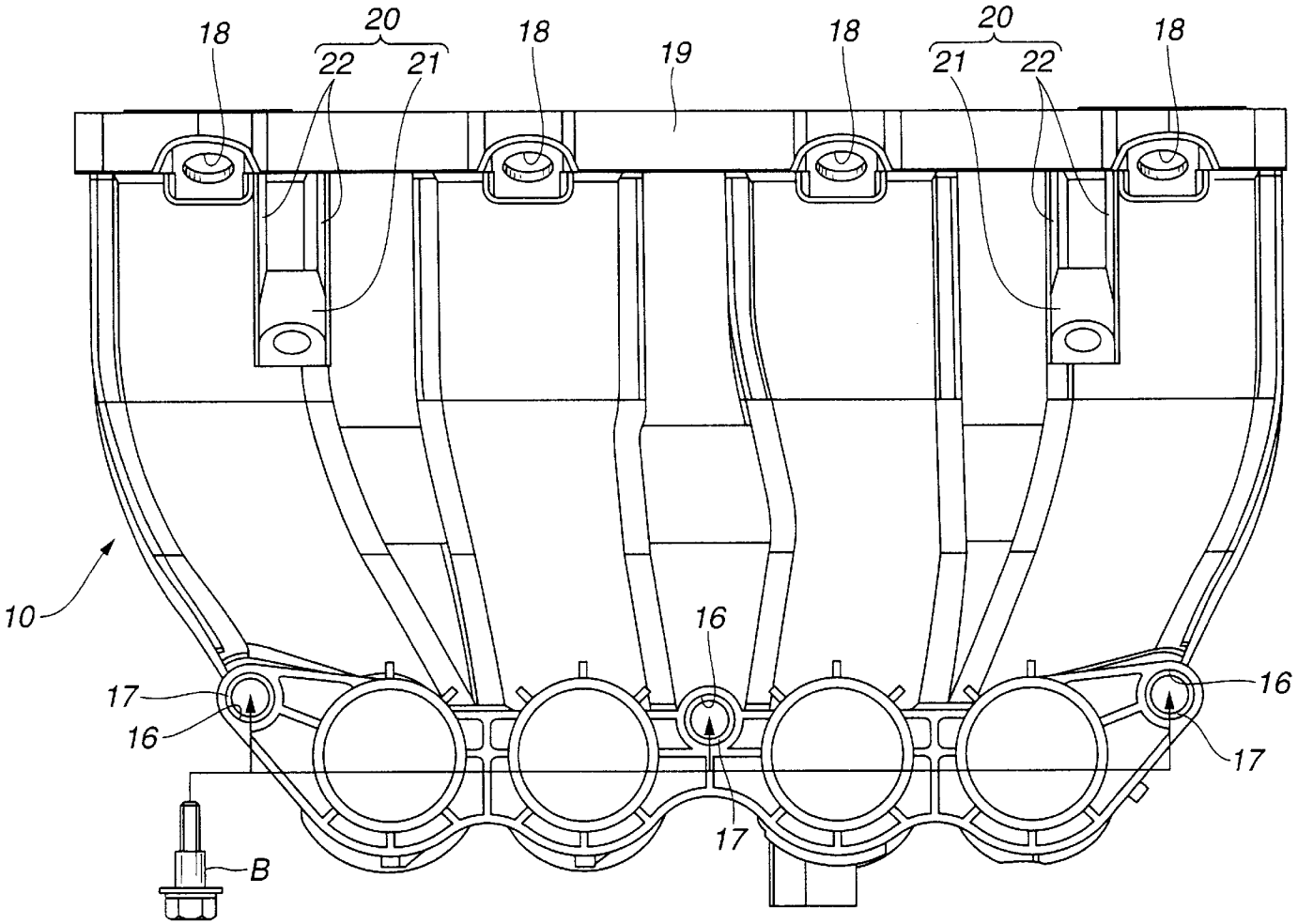
FIG. 4 is a plan view of a lower branch of an intake manifold in the arrangement of FIG. 1.

As illustrated in FIG. 4, lower branch 10 has bolt holes 16 for tap bolts B. Sleeve 17 which is made of resin material and has an internal thread, is fixed into each of bolt holes 16. Each of tap bolts B is screwed into sleeve 17 from a lower side of lower branch 10 upon coupling lower branch 10 with upper branch 9. Each of bolt holes 16 is located on the side closer to the engine than each of the snap-fit assemblies, namely, on the upper side of FIG. 4. Bolt holes 16 are arranged substantially in line along the longitudinal axis of collector 2. Lower branch 10 has a downstream end portion formed with intake port flange 19. Intake port flange 19 is mounted to cylinder head 104 of engine 100 shown in FIG. 8. The downstream end portion of lower branch 10, i.e., the downstream end portion of branch portion 3, allows the air to be introduced into the cylinders via intake port 106 of cylinder head 104. Reference numeral 18 denotes a mount hole for fuel injector 5 shown in FIG. 3.

Protector mounts 20, 20 for mounting protector 6 are disposed on the downstream end portion of lower branch 10 but upstream of intake port flange 19. Protector mounts 20, 20 are disposed on an outer surface of an upper side of the downstream end portion of lower branch 10. Protector mounts 20, 20 are spaced from and opposed to each other along the direction of the row of the engine cylinders. Namely, protector mounts 20, 20 are located on the left and right sides in FIG. 4. Each of protector mounts 20, 20 includes boss 21 and two opposed ribs 22. Boss 21 outward projects from the outer surface of the downstream end portion of lower branch 10 and spaced from intake port flange 19. Ribs 22 extend between boss 21 and intake port flange 19 and connect them.

Figure 5:
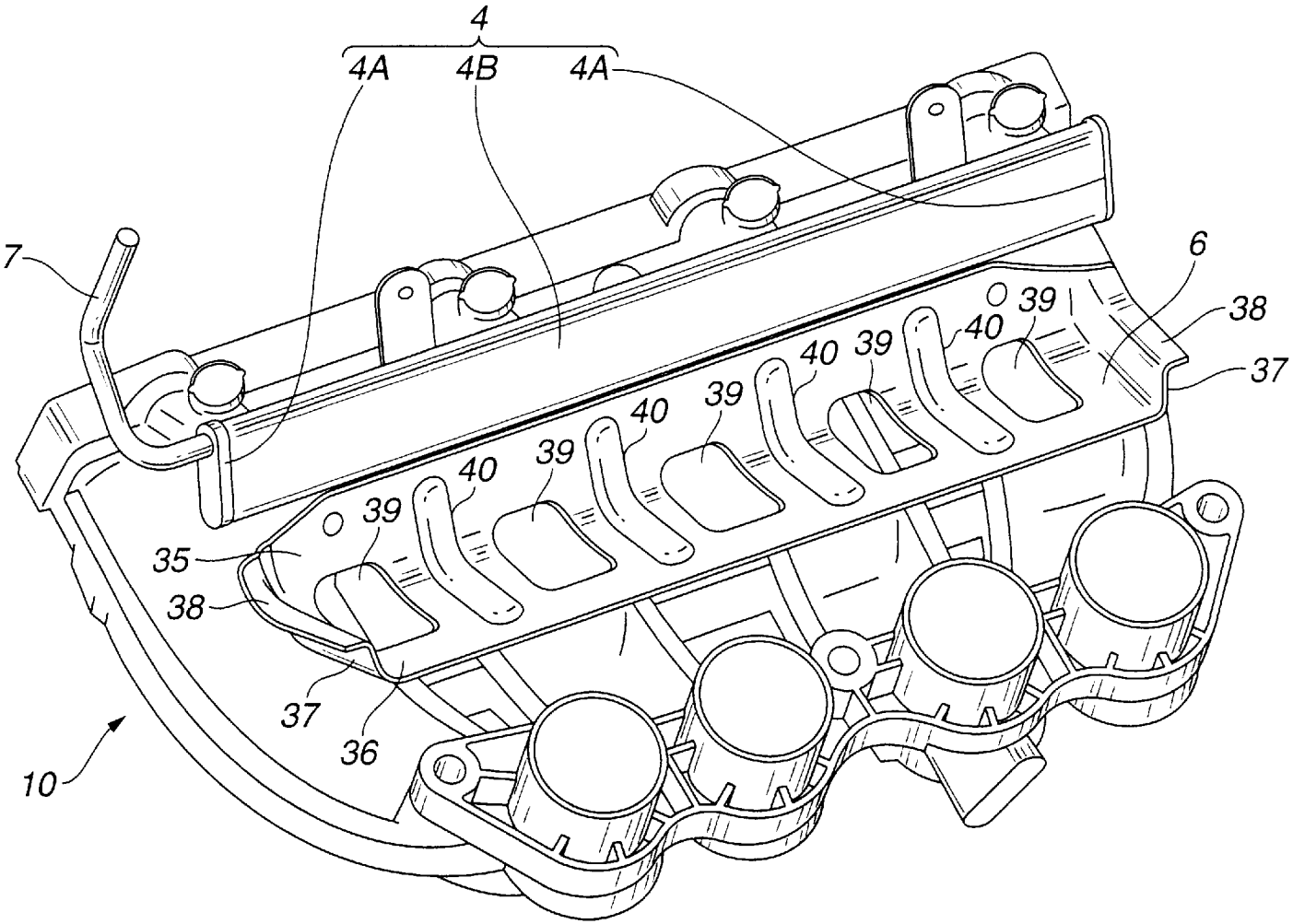
FIG. 5 is a perspective view of the intake arrangement, showing the lower branch to which a protector and a fuel pipe are mounted.

As illustrated in FIG. 3, protector 6 is secured to protector mounts 20, 20 of lower branch 10 together with fuel pipe 4 having fuel injector 5. Fuel injector 5 is preassembled to fuel pipe 4. Fuel pipe 4 is connected with a fuel tank via fuel tube 7 and supplies fuel from the fuel tank to fuel injector 5. Fuel pipe 4 extends along the longitudinal axis of collector 2, i.e., in the direction of the row of engine cylinders. As illustrated in FIG. 5, fuel pipe 4 has end portions 4A, 4A opposed to each other in the longitudinal direction and general portion 4B extending between end portions 4A, 4A. End portions 4A, 4A have rigidity larger than that of general portion 4B. Fuel pipe 4 has mount 23 which is interposed between protector 6 and protector mounts 20, 20. Fuel pipe 4 is fixed to protector mounts 20, 20 via mount 23.

Specifically, as shown in FIG. 3, lower branch 10 includes a pair of members 25 and 26 coupled with each other and split surface 24 disposed between the pair of members 25 and 26. At the downstream end portion of lower branch 10, one member 25 is located on an upper side of lower branch 10 and provided with protector mount 20, and the other member 26 is located on a lower side of lower branch 10. Namely, at the downstream end portion of lower branch 10, one member 25 and the other member 26 are located on an upper side of the vehicle and a lower side thereof, respectively. Two members 25 and 26 are joined together at split surface 24 by vibration welding. Split surface 24 extends substantially along the flow of the air introduced into lower branch 10 and flowing to intake ports 106 of cylinder head 104 of engine 100. Split surface 24 is curved toward member 26, namely, downwardly as viewed in FIG. 3. Split surface 24 has downstream end 24A disposed at the downstream end portion of lower branch 10. Downstream end 24A is located in the lower side surface of lower branch 10 in a circumferentially opposed relation to protector mount 20 disposed on the upper side surface of lower branch 10. Member 25 has step 27 formed on an outer surface thereof upstream of protector mount 20. Member 25 has a reduced thickness on the upstream side of step 27 which is smaller than a thickness on the downstream side of step 27. Split surface 24 and step 27 act as a split induction portion which induces a split in branch portion 3 upon an impact load being applied to branch portion 3. Split surface 24 acts to divide lower branch 10 into members 25 and 26 along the branch flows in lower branch 10 as explained later. Step 27 acts to bend member 25 toward fuel pipe 4 as explained later.

Upper branch 9 includes a pair of members 29 and 30 coupled with each other and split surface 28 between the pair of members 29 and 30. Split surface 28 extends substantially in the direction of the flow of the air introduced into upper branch 9. Two members 29 and 30 are joined together at split surface 28 by vibration welding.

Protector 6 disposed between fuel pipe 4 and branch portion 3 has a generally L-shape as shown in FIG. 3. Protector 6 extends along fuel pipe 4 over the longitudinal length of fuel pipe 4 and the lateral width thereof perpendicular to the longitudinal length as shown in FIG. 5. As illustrated in FIG. 6, protector 6 includes base wall 35 and cover wall 36 which are integrally formed with each other. Base wall 35 is fixed to protector mount 20 of lower branch 10. Cover wall 36 is bent at a predetermined angle relative to base wall 35. The predetermined angle may be about 90 degrees. Protector 6 also has, at opposed ends thereof, side walls 37, 37 with flanges 38, 38. Side walls 37, 37 upward extend from cover wall 36 in an opposed relation to each other and are connected with base wall 35. Side walls 37, 37 are substantially perpendicular to base wall 35 and cover wall 36. Flanges 38, 38 are outward bent at upper ends of side walls 37, 37. Flanges 38, 38 are integrally formed with side walls 37, 37. Protector 6 is formed by bending a metal sheet.

A plurality of generally rectangular-shaped openings 39 are formed in protector 6. Openings 39 are spaced from each other in the longitudinal direction of protector 6. Each of openings 39 extends across base wall 35 and cover wall 36 in a transverse direction relative to the longitudinal direction of protector 6. A plurality of beads 40 are disposed between openings 39, which extend across base wall 35 and cover wall 36 in the transverse direction relative to the longitudinal direction of protector 6. Beads 40 have a larger length than openings 39. Beads 40 are provided by press forming so as to project from an inner surface of L-shaped protector 6, namely, project upward in FIG. 3. Beads 40 extend from an inner surface of cover wall 36 to a lesser extent than side walls 37. Namely, beads 40 have a height from the inner surface of cover wall 36 which is smaller than a length of side walls 37 of protector 6. The height of beads 40 is preset such that beads 40 can be prevented from being contacted with fuel pipe 4 before flanges 38, 38 come into contact with opposed ends 4A, 4A of fuel pipe 4 upon deformation of protector 6 as explained later. Cover wall 36 defines one end 39A of each opening 39 and one end 40A of each bead 40, and base wall 35 defines an opposite end of each opening 39 and an opposite end of each bead 40. Specifically, cover wall 36 has a peripheral edge which extends in the longitudinal direction of protector 6 on an opposite side of the joint periphery connected with base wall 35. One end 39A of each opening 39 and one end 40A of each bead 40 are located close to the peripheral edge of cover wall 36. As shown in FIG. 6, distance L1 between one end 39A and the peripheral edge of cover wall 36 is larger than distance L2 between one end 40A and the peripheral edge of cover wall 36. In other words, one end 39A is located closer to base wall 35 than one end 40A.

When the vehicle having the above-described arrangement undergoes collision, a relatively large impact load F is applied to branch portion 3 via the engine room as indicated in FIG. 3. The application of large impact load F causes projection 13 and hole 15 of the snap-fit assembly to be disengaged from each other, and causes sleeves 17 with bolts B to be fallen from bolt holes 16. This permits U-shaped branch portion 3 to be divided at bent portion 8 into upper branch 9 and lower branch 10. At this state, lower branch 10 fixed to engine cylinder head 104 is restricted in the displacement in the engine room, while upper branch 9 and collector 2 are allowed to move therein. Lower branch 10 absorbs the impact energy to be deformed into the state shown in FIG. 7. In this state, lower branch 10 is bent at step 27 of upper member 25 toward fuel pipe 4 and split along split surface 24 such that upper member 25 and lower member 26 are separated from each other at split surface 24. Lower branch 10 bent is in contact with protector 6 and urges protector 6 such that cover wall 36 is bent toward fuel pipe 4, i.e., leftward in FIG. 7. Protector 6 is plastically deformed into a bent state as shown in FIG. 7. At the bent state, fuel pipe 4 is covered by protector 6 over the longitudinal length of fuel pipe 4 and the lateral width thereof.

If protector 6 is further deformed to come closer to fuel pipe 4, flanges 38, 38 of protector 6 will be brought into contact with opposed ends 4A, 4A of fuel pipe 4. Even in such a condition, since opposed ends 4A, 4A have the increased rigidity, fuel pipe 4 can be prevented from being readily deformed at opposed ends 4A, 4A due to the contact with flanges 38, 38. Further, owing to the preset height of beads 40 which is smaller than that of side walls 37, 37, beads 40 can be prevented from the contact with fuel pipe 4 before flanges 38, 38 are contacted with opposed ends 4A, 4A of fuel pipe 4.

If protector 6 undergoes a relatively small impact load upon being contacted with lower branch 10, protector 6 will be free from plastic deformation and will be elastically deformed to absorb the impact energy.

With the above-described arrangement, upon application of a relatively large impact load to branch portion 3 of intake manifold 1 in such a case as vehicle collision, the impact energy can be absorbed by deformation of protector 6 so that fuel pipe 4 can be protected from deformation as explained above.

Further, the impact energy also can be absorbed and reduced by three-stage split of branch portion 3. The three stages of split of branch portion 3 are as follows: at the first stage upper branch 9 and lower branch 10 are separated at bent portion 8 of branch portion 3; at the second stage lower branch 10 is bent at step 27 and separated along split surface 24; and at the third stage protector 6 is deformed by lower branch 10 bent and separated. This serves for ensuring protection of fuel pipe 4 upon application of the impact load. In addition, the split of lower branch 10 is conducted at step 27 and split surface 24 which act as the split induction portion. This can prevent protector mount 20, 20 from being deformed due to the impact load applied to branch portion 3. Therefore, protector 6 fixed to protector mount 20, 20 can perform protection of fuel pipe 4 upon application of the impact load.

Further, with the arrangement of protector 6, the rigidity of intake manifold 1 made of resin material can be enhanced, and vibration of intake manifold 1 which occurs during an ordinary operation of the vehicle can be reduced. Furthermore, protector 6 is secured together with fuel pipe 4 and fuel injector 5 to the downstream end portion of lower branch 10 at the opposed ends spaced from each other in the direction of the row of engine cylinders. This can prevent vibration of fuel pipe 4 and fuel injector 5, serving for suppressing offset of the target area where fuel injection is provided.

Protector 6 can be readily formed by bending the metal sheet, whereby the production cost can be saved. Further, openings 39 and beads 40 alternately arranged in protector 6 cooperate to provide protector 6 with appropriate rigidity and control deformation of protector 6 so as to bend substantially perpendicular to a direction of the longitudinal length of fuel pipe 4. Furthermore, as described above, distance L1 between the peripheral edge of cover wall 36 and one end of each opening 39 which is located in cover wall 36 is set larger than distance L2 between the peripheral edge of cover wall 36 and one end of each bead 40 which is located in cover wall 36. The setting of distance L1 relative to distance L2 can control deformation of protector 6 so as to uniformly proceed along the longitudinal direction of protector 6, i.e., the direction of the row of engine cylinders, without distortion or twisting relative to the longitudinal direction. Further, with the provision of openings 39 in protector 6, heat transmitted from fuel pipe 4 and fuel injector 5 adjacent to protector 6 to protector 6 can be effectively emitted to the atmosphere. Therefore, protector 6 can be improved in cooling efficiency and can act as an effective cooling member for intake manifold 1, fuel pipe 4 and fuel injector 5. Meanwhile, beads may be formed to project from an outer surface of L-shaped protector 6 toward lower branch 10. However, beads 40 of this embodiment which upward project from the inner surface of L-shaped protector 6 is preferable from the viewpoint of layout, wherein a space between protector 6 and lower branch 10 can be reduced as compared with protector 6 having the beads projecting from the outer surface.

The combined use of bolts B and the snap-fit assemblies for coupling upper branch 9 and lower branch 10 can improve efficiency of the coupling operation of upper branch 9 and lower branch 10 and can limit the number of bolts to the minimum. Further, with the combined use of bolts B and the snap-fit assemblies, the coupling force of upper branch 9 and lower branch 10 can be maintained to a required extent. As a result, U-shaped branch portion 3 can be separated at bent portion 8 into upper branch 9 and lower branch 10 upon a relatively large impact load being applied to branch portion 3. The above-described three-stage split of branch portion 3 can be performed to gradually absorb the impact energy and ensure protection of fuel pipe 4 from deformation due to the impact energy.

Further, generally U-shaped branch portion 3 can serve for reducing a size of the whole intake manifold 1. In addition, intake manifold 1 can be readily produced using branch portion 3 formed by upper and lower branches 9 and 10 coupled together, in which upper and lower branches 9 and 10 are composed of one pair of coupled members 29 and 30 and the other pair of coupled members 25 and 26, respectively.

Furthermore, protector mount 20, 20 constituted of boss 21 and ribs 22 can be formed by a reduced amount of resin material but can have rigidity to endure an impact load applied to branch portion 30.

This application is based on prior Japanese Patent Application No. 2001-321927 filed on Oct. 19, 2001, the entire content of which is hereby incorporated by reference.

Although the invention has been described above by reference to a certain embodiment of the invention, the invention is not limited to the embodiment described above. Modifications and variations of the embodiment described above will occur to those skilled in the art in light of the above teachings. The scope of the invention is defined with reference to the following claims.

What is claimed is:

1. An intake arrangement for a multi-cylinder internal combustion engine of a vehicle, the engine having a row of cylinders, the arrangement comprising:

an intake manifold including a collector adapted to extend along a direction of the row of the cylinders and a branch portion communicated with the collector, the intake manifold being adapted to introduce air to the cylinders via the collector and the branch portion, the branch portion having a downstream end portion allowing the air to be introduced into the cylinders;

a fuel pipe disposed at the downstream end portion of the branch portion, the fuel pipe extending along the collector; and a protector secured to the downstream end portion of the branch portion, the protector extending along the fuel pipe between the branch portion and the fuel pipe, the protector being deformable to cover the fuel pipe upon an impact load being applied to the branch portion.

2. The intake arrangement as claimed in claim 1, wherein the intake manifold is made of resin material.

3. The intake arrangement as claimed in claim 1, wherein the protector comprises a base wall fixed to the branch potion, a cover wall bent at a predetermined angle relative to the base wall, and a pair of opposed side walls extending in a direction substantially perpendicular to the base wall and the cover wall.

4. The intake arrangement as claimed in claim 1, wherein the protector is secured to protector mounts of the downstream end portion of the branch portion which are spaced from and opposed to each other along the direction of the row of the engine cylinders.

5. An intake arrangement for a multi-cylinder internal combustion engine of a vehicle, the engine having a row of cylinders, the arrangement comprising:

an intake manifold including a collector adapted to extend along a direction of the row of the cylinders and a branch portion communicated with the collector, the intake manifold being adapted to introduce air to the cylinders via the collector and the branch portion, the branch portion having a downstream end portion allowing the air to be introduced into the cylinders;

a fuel pipe disposed at the downstream end portion of the branch portion, the fuel pipe extending along the collector; and a protector secured to the downstream end portion of the branch portion, the protector extending along the fuel pipe between the branch portion and the fuel pipe, the protector being deformable to cover the fuel pipe upon an impact load being applied to the branch portion, wherein the protector comprises a base wall fixed to the branch portion and a cover wall bent relative to the base wall, a pair of opposed side walls extending in a direction substantially perpendicular to the base wall and the cover wall, and flanges outwardly bent relative to the opposed side walls.

6. The intake arrangement as claimed in claim 5, wherein the protector comprises a plurality of openings and a plurality of beads disposed between the openings, the openings and the beads extending across the base wall and the cover wall in a transverse direction relative to a longitudinal direction of the protector.

7. The intake arrangement as claimed in claim 6, wherein the cover wall defines first ends of the openings and second ends of the beads, the first ends being located closer to the base wall than the second ends.

8. The intake arrangement as claimed in claim 7, wherein the cover wall has a peripheral edge extending along the fuel pipe, a first distance between the first ends and the peripheral edge of the cover wall being larger than a second distance between the second ends and the peripheral edge of the cover wall.

9. The intake arrangement as claimed in claim 6, wherein the beads extend from an inner surface of the cover wall to a lesser extent than the side walls.

10. An intake arrangement for a multi-cylinder internal combustion engine of a vehicle, the engine having a row of cylinders, the arrangement comprising:

an intake manifold including a collector adapted to extend along a direction of the row of the cylinders and a branch portion communicated with the collector, the intake manifold being adapted to introduce air to the cylinders via the collector and the branch portion, the branch portion having a downstream end portion allowing the air to be introduced into the cylinders;

a fuel pipe disposed at the downstream end portion of the branch portion, the fuel pipe extending along the collector; and a protector secured to the downstream end portion of the branch portion, the protector extending along the fuel pipe between the branch portion and the fuel pipe, the protector being deformable to cover the fuel pipe upon an impact load being applied to the branch portion, wherein the branch portion comprises a protector mount to which the protector is mounted, and a split induction portion inducing a split in the branch portion upon the impact load being applied to the branch portion, the protector mount being spaced from the split induction portion so as to avoid the split.

11. The intake arrangement as claimed in claim 10, wherein the engine comprises a cylinder head having intake ports through which the air flows into the cylinders, the collector being adapted to be disposed above the cylinder head and extend along the direction of the row of cylinders, the branch portion having a generally U-shape and including an upper branch and a lower branch which are joined with each other at a bent portion of the U-shape, the branch portion being adapted to connect the collector to the intake ports, the lower branch including a first member having the protector mount, a second member, a split surface on which the first and second members being joined together, and a downstream end portion in which the first member is located on an upper side of the vehicle as compared to the second member, the protector mount being disposed on an outer surface of the first member at the downstream end portion of the lower branch, the split surface extending substantially along the flow of the air flowing in the lower branch, the split surface including a downstream end located in an outer surface of the downstream end portion of the lower branch in a circumferentially opposed relation to the protector mount.

12. The intake arrangement as claimed in claim 11, wherein the split induction portion comprises the split surface and a step formed on the first member upstream of the protector mount, the first member having a reduced thickness on the upstream side of the step.

13. The intake arrangement as claimed in claim 12, wherein the upper and lower branches are joined together by bolts and a snap-fit assembly, the bolts being located closer to the engine than the snap-fit assembly.

14. The intake arrangement as claimed in claim 10, wherein the downstream end portion of the branch portion comprises an intake port flange mounted to the cylinder head, the protector mount being disposed upstream of the intake port flange, the protector mount comprising a boss outward projecting from an outer surface of the downstream end portion of the branch portion and a rib connecting the boss and the intake port flange.

15. The intake arrangement as claimed in claim 10, wherein the downstream end portion of the branch portion comprises an intake port flange mounted to the cylinder head, the protector mount being disposed upstream of the intake port flange, the protector mount comprising a boss outward projecting from an outer surface of the downstream end portion of the branch portion and a plurality of ribs connecting the boss and the intake port flange.

16. An intake arrangement for a multi-cylinder internal combustion engine of a vehicle, the engine having a row of cylinders, the arrangement comprising:

an intake manifold including branch means for allowing a flow of air to be divided into branch flows introduced into the cylinders;

pipe means for supplying fuel to the cylinders on a downstream side of the branch means; and protector means for preventing the pipe means from being deformed upon an impact load being applied to the branch means, the protector means being deformable to cover the pipe means upon the application of the impact load.

17. An intake arrangement for a multi-cylinder internal combustion engine of a vehicle, the engine having a row of cylinders, the arrangement comprising:

an intake manifold including branch means for allowing a flow of air to be divided into branch flows introduced into the cylinders;

pipe means for supplying fuel to the cylinders on a downstream side of the branch means; and protector means for preventing the pipe means from being deformed upon an impact load being applied to the branch means, the protector means being deformable to cover the pipe means upon the application of the impact load, wherein the protector means comprises control means for controlling deformation of the protector means so as to bend in a direction substantially perpendicular to the pipe means.

18. The intake arrangement as claimed in claim 17, wherein the control means comprises means for preventing distortion of the deformation of the protector means.

19. An intake arrangement for a multi-cylinder internal combustion engine of a vehicle, the engine having a row of cylinders, the arrangement comprising:

an intake manifold including branch means for allowing a flow of air to be divided into branch flows introduced into the cylinders;

pipe means for supplying fuel to the cylinders on a downstream side of the branch means; and protector means for preventing the pipe means from being deformed upon an impact load being applied to the branch means, the protector means being deformable to cover the pipe means upon the application of the impact load, wherein the protector means comprises cooling means for cooling the protector means by emitting heat transmitted from the pipe means to the protector means.

20. An intake arrangement for a multi-cylinder internal combustion engine of a vehicle, the engine having a row of cylinders, the arrangement comprising:

an intake manifold including branch means for allowing a flow of air to be divided into branch flows introduced into the cylinders;

pipe means for supplying fuel to the cylinders on a downstream side of the branch means; and protector means for preventing the pipe means from being deformed upon an impact load being applied to the branch means, the protector means being deformable to cover the pipe means upon the application of the impact load, wherein the branch means comprises split induction means for inducing a split in the branch means upon the application of the impact load.

21. The intake arrangement as claimed in claim 20, wherein the split induction means comprises split means for dividing the branch means into portions.

22. The intake arrangement as claimed in claim 21, wherein the split means divides the branch means into portions along the branch flows in the branch means.

23. The intake arrangement as claimed in claim 20, wherein the split induction means comprises means for bending the branch means toward the pipe means.

* * * * *